US005340416A

United States Patent [19]

Shibata et al.

[11] Patent Number: 5,340,416

[45] Date of Patent: Aug. 23, 1994

[54] HIGH-STRENGTH MAGNESIUM-BASED ALLOY

[75] Inventors: Toshisuke Shibata, Kawasaki; Akihisa Inoue, 11-806, Kawauchijutaku, Mubanchi, Kawauchi, Aoba-ku, Sendai-shi, Miyagi-ken; Tsuyoshi Masumoto, Sendai, all of Japan

[73] Assignees: Tsuyoshi Masumoto; Yoshida Kogyo K.K.; Akihisa Inoue, Tokyo, Japan

[21] Appl. No.: 997,780

[22] Filed: Dec. 28, 1992

[30] Foreign Application Priority Data

Dec. 26, 1991 [JP] Japan ..... 3-345469

[51] Int. Cl.[5] ..... C22C 23/02

[52] U.S. Cl. ..... 148/420; 148/666; 420/407

[58] Field of Search ..... 148/420, 666; 420/408, 420/407

[56] References Cited

U.S. PATENT DOCUMENTS 5,118,368 6/1992 Masumoto et al. ..... 148/420
5,147,603 9/1992 Nussbaum et al. ..... 148/420

FOREIGN PATENT DOCUMENTS 0166917 1/1986 European Pat. Off. .
0219628 4/1987 European Pat. Off. .
0465376 1/1992 European Pat. Off. .
3-10041 1/1991 Japan .
3-47941 2/1991 Japan .
3-87339 4/1991 Japan .

*Primary Examiner*—Melvyn J. Andrews
*Assistant Examiner*—Sikyin Ip
*Attorney, Agent, or Firm*—Hill, Steadman & Simpson

[57] ABSTRACT

A high-strength magnesium-based alloy possessing a microcrystalline composition represented by the general formula: $Mg_aAl_bM_c$ or $Mg_{a'}Al_bM_cX_d$ (wherein M stands for at least one element selected from the group consisting of Ga, Sr, and Ba, X stands for at least one element selected from the group consisting of Zn, Ce, Zr, and Ca, and a, a', b, c, and d stand for atomic percents respectively in the ranges of $78 \leqq a \leqq 94$, $75 \leqq a' \leqq 94$, $2 \leqq b \leqq 12$, $1 \leqq c \leqq 10$, and $0.1 \leqq d \leqq 3$). This alloy can be advantageously produced by rapidly solidifying the melt of an alloy of the composition shown above by the liquid quenching method. It is useful as high-strength materials and highly refractory materials owing to its high hardness, strength, and heat-resistance. It is also useful as materials with high specific strength because of light weight and high strength.

9 Claims, 3 Drawing Sheets

HIGH-STRENGTH MAGNESIUM-BASED ALLOY

BACKGROUND OF THE INVENTION

1. Field of the Invention

This invention relates to high-strength magnesium-based alloys obtained by the rapid solidification method or quench solidifying method.

2. Description of the Prior Art

The magnesium-based alloys heretofore known to the art include those of the compositions of Mg-Al, Mg-Al-Zn, Mg-Th-Zr, Mg-Th-Zn-Zr, Mg-Zn-Zr, and Mg-Zn-Zr-RE (rate earth element). Depending on their material characteristics, these magnesium-based alloys have been finding extensive utility as light-weight structural materials for aircraft and vehicles, as materials for storage batteries, and as sacrifice electrodes, for example. The conventional magnesium-based alloys of varying types cited above, however, are generally deficient in hardness and strength.

As materials obtainable by the rapid solidification method, magnesium-based alloys of varying compositions have been developed. For example, Japanese Patent Application laid open to public inspection, KOKAI (Early Publication) No. 3-87339 (87,339/1991) discloses a magnesium-based alloy of Mg-M-X [wherein M stands for Al, Si, Ca, Cu, Ni, Sn, or Zn and X for Y, La, Ce, Sm, Nd, or Mm (misch metal)] and Japanese Patent Application, KOKAI No. 3-10041 (10,041/1991) discloses magnesium-based alloys of Mg-X, Mg-X-M, Mg-X-Ln, and Mg-X-M-Ln (wherein X stands for Cu, Ni, Sn, or Zn, M for Al, Si, or Ca, and Ln for Y, La, Ce, Nd, Sm, or Mm). These magnesium-based alloys, however, are amorphous alloys containing at least 50% by volume of an amorphous phase.

As respects crystalline magnesium-based alloys, Japanese Patent application, KOKAI No. 3-47941 (47,941/1991) discloses magnesium-based alloys of Mg-X, Mg-X-M, Mg-X-Ln, and Mg-X-M-Ln (wherein X stands for Cu, Ni, Sn, or Zn, M for Al, Si, or Ca, and Ln for Y, La, Ce, Nd, Sm, or Mm). Though the magnesium-based alloys reported in said Japanese Patent application, KOKAI No. 3-47941 are excellent in hardness and tensile strength, they are imperfect in terms of thermal stability and specific strength and have room for improvement.

SUMMARY OF THE INVENTION

An object of this invention, therefore, is to provide a magnesium-based alloy which possesses high hardness, high strength, and high heat-resistance, exhibits high specific strength, and proves to be useful as a high-strength material, a highly heat-resistant material, and a light, strong material of high specific strength.

Another object of this invention is to provide a magnesium-based alloy which excels in such characteristic properties as strength at elevated temperatures, strength in heat treatment, elongation at room temperature, and Young's modulus and, therefore, endures working by extrusion and forging, for example.

To accomplish the objects mentioned above, in accordance with the first aspect of this invention, there is provided a high-strength magnesium-based alloy possessing a microcrystalline composition represented by the general formula: $Mg_aAl_bM_c$ (wherein M stands for at least one element selected from the group consisting of Ga, Sr, and Ba and a, b, and c stand for atomic percents falling respectively in the ranges, $78 \leqq a \leqq 94$, $2 \leqq b \leqq 12$, and $1 \leqq c \leqq 10$).

In accordance with the second aspect of this invention, there is provided a high-strength magnesium-based alloy possessing a microcrystalline composition represented by the general formula: $Mg_{a'}Al_bM_cX_d$ (wherein M stands for at least one element selected from the group consisting of Ga, Sr, and Ba, X stands for at least one element selected from the group consisting of Zn, Ce, Zr, and Ca, and a', b, c, and d stand for atomic percents falling respectively in the ranges, $75 \leqq a' \leqq 94$, $2 \leqq b \leqq 12$, $1 \leqq c \leqq 10$, and $0.1 \leqq d \leqq 3$). A preferred embodiment of this invention provides a high-strength magnesium-based alloy possessing a microcrystalline composition represented by the general formula: $Mg_{a'}Al_bGa_cX_d$ (wherein X and a', b, c, and d have the same meanings as defined above).

DETAILED DESCRIPTION OF THE INVENTION

Figure 1:
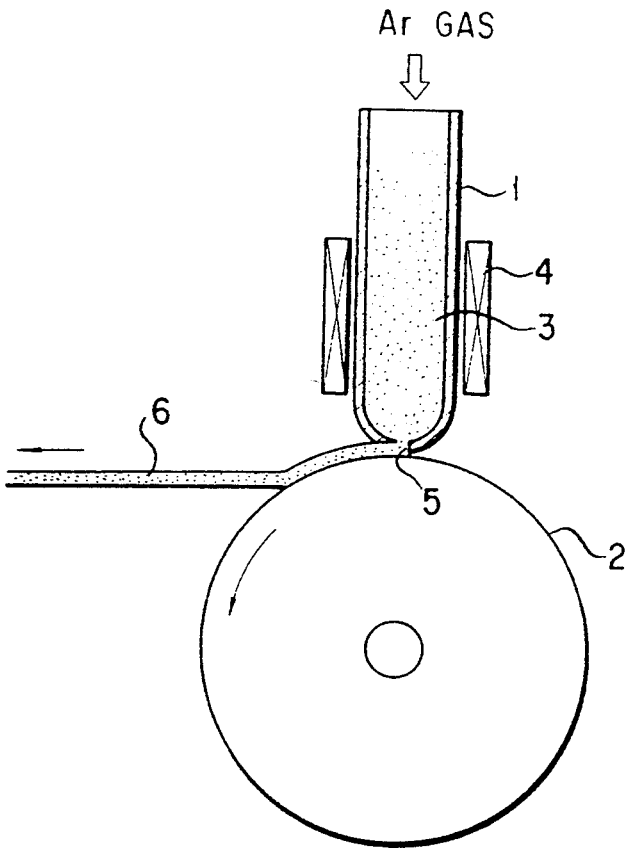
FIG. 1 is an explanatory diagram schematically illustrating the construction of an example of the apparatus for the production of a magnesium-based alloy of this invention.

The magnesium-based alloy of this invention possesses a composition of $Mg_aAl_bM_c$ or $Mg_{a'}Al_bM_cX_d$ (wherein M stands for at least one element selected from the group consisting of Ga, Sr, and Ba and X for at least one element selected from the group consisting of Zn, Ce, Zr, and Ca) and has the intermetallic compounds of Mg and other alloy elements mentioned above dispersed homogeneously and finely in a magnesium matrix of a hexagonal close-packed structure (hereinafter referred to briefly as "h.c.p.").

In the magnesium-based alloy of this invention mentioned above, a is limited to the range of 78 to 94 atomic %, a' to that of 75 to 94 atomic %, b to that of 2 to 12 atomic %, c to that of 1 to 10 atomic %, and d to that of 0.1 to 3 atomic % respectively for the purpose of ensuring formation of a supersaturated solid solution surpassing the limit of equilibrium solid solution and production of the alloys of the microcrystalline phases by the rapidly solidifying means on a commercial basis by utilizing the liquid quenching technique, for example. Another important reason for fixing the ranges mentioned above resides in ensuring precipitation of fine h.c.p. Mg and further uniform precipitation of intermetallic compounds of at least Mg and other alloy elements. By enabling the intermetallic compounds containing at least Mg as one of the components thereof to be uniformly and finely dispersed in the Mg matrix of h.c.p. mentioned above, the supersaturated Mg matrix can be reinforced and the strength of the alloy can be enhanced conspicuously. Even if the amount of Mg is less than 78 atomic %, the alloy containing an amorphous phase in a certain proportion can be obtained and the amorphous phase can be decomposed by heating this amorphous alloy at a prescribed temperature. When a crystalline alloy is produced by thermal decomposition as described above, however, this crystalline alloy suffers from unduly low toughness because the intermetallic compound is precipitated simultaneously with or preferentially over the precipitation of the h.c.p. Mg during the thermal decomposition. If the amount of Mg is less than 78 atomic %, the alloys similar to that just described can be obtained by decreasing the cooling rate. The alloy thus produced only betrays deficiency in ductility because it fails to acquire a supersaturated solid solution in the cooled state and the coarse compound phases precipitate with coarse Mg matrix.

In the magnesium-based alloy of this invention, the element Al manifests an excellent effect of forming a supersaturated solid solution or metastable intermetallic compound with magnesium and other additive elements and, at the same time, of stabilizing a microcrystalline phase, and enhances strength of the alloy without any sacrifice of ductility.

The element Ga forms a stable or metastable intermetallic compound with magnesium and other additive elements, causes this intermetallic compound to be uniformly and finely dispersed in the magnesium matrix ($\alpha$ phase), conspicuously enhances hardness and strength of the alloy, suppresses the otherwise inevitable coarening of the microcrystalline phase at elevated temperatures, and imparts heat-resistance to the alloy. This effect of the Ga can be obtained by using Sr or Ba in the place of Ga.

The element X stands for at least one element selected from the group consisting of Zn, Ce, Zr, and Ca. When this element is added in a minute amount to the aforementioned alloy (Mg-Al-Ga), it has an effect of improving the fineness of texture of the microcrystalline phase and the intermetallic compound and consequently ensuring further improvement of the alloy and enhancement of specific strength of the alloy. This element is particularly advantageous because no rapid cooling is obtained effectively on the low solute content side.

The magnesium-based alloy of this invention can be advantageously produced by preparing the alloy of the prescribed composition and using rapidly solidifying process such as the liquid quenching method. The cooling in this case is effected advantageously at a rate in the range of from $10^2$ to $10^6$ K/sec.

The magnesium-based alloy of this invention is useful as high-strength materials and highly refractory materials owing to its high hardness, strength, and heat-resistance. It is also useful as materials with high specific strength because of light weight and high strength. Since this alloy excels in strength at elevated temperatures, ability to retain strength intact during the course of a heat treatment, elongation at room temperature, and Young's modulus, it can be worked by extrusion and forging. The shaped articles produced by working this alloy, therefore, enjoy the outstanding mechanical properties which are inherent in the alloy as the starting material.

Now, this invention will be described more specifically below with reference to working examples. As a matter of course, this invention is not limited to the following examples. It ought to be easily understood by any person of ordinary skill in the art that this invention allows various modifications within the scope of the spirit of this invention.

EXAMPLE 1

A molten alloy 3 of a prescribed percentage composition was prepared by the use of a high-frequency blast furnace. This molten alloy 3 was introduced into a quartz tube 1 provided at the leading terminal thereof with a small hole 5 (0.5 mm in diameter) as illustrated in FIG. 1 and was thermally melted by means of a high-frequency heating coil 4 wound around the quartz tube 1. Then, the quartz tube 1 was set in place directly above a roll 2 made of copper. The roll 2 was kept rotated at a high speed in the range of from 3,000 to 5,000 r.p.m. and the molten alloy 3 in the quartz tube 1 was spouted under the pressure of argon gas (0.7 kg/cm$^2$) through the small hole 5 of the quartz tube 1. A thin alloy strip 6 was obtained by bringing the spouted alloy into contact with the surface of the roll 2 in rotation and rapidly solidifying the alloy.

Twenty thin alloy strips (1 mm in width and 20 $\mu$m in thickness) varying in composition as shown in Tables 1 to 3 were produced under the conditions mentioned above.

The thin alloy strips were each subjected to X-ray diffraction and tested for such mechanical properties as hardness (Hv), tensile strength ($\sigma f$), elongation at break ($\epsilon f$), Young's modulus (E), and specific strength ($\sigma f/\rho$). The results are shown in the Tables 1 to 3. The hardness (Hv) is the magnitude (DPN) measured with a microVickers hardness tester operated under a load of 25 g, the specific strength is the magnitude obtained by dividing the tensile strength by the density. When the alloys indicated in Tables 1 to 3 were examined under a transmission electron microscope (TEM), they were found to have crystal grain sizes of not more than 1.0 $\mu$m and have intermetallic compounds of Mg with Al or with Ga, Sr, or Ba uniformly and finely dispersed in a Mg matrix of h.c.p.

TABLE 1

| | C.* (at %) | | | | Hv | $\sigma_f$ | $\epsilon_f$ | E | |
|---|---|---|---|---|---|---|---|---|---|
| No. | Mg | Al | Ga | Phase | (DPN) | (MPa) | (%) | (GPa) | $\sigma_f/\rho$ |
| 1 | 90 | 8 | 2 | Mg + $Al_2Mg_3$ | 122 | 461 | 1.4 | 35 | 247 |
| 2 | 91 | 8 | 1 | Mg + $Al_2Mg_3$ | 123 | 373 | 1.8 | 34 | 203 |
| 3 | 90 | 2 | 8 | Mg + $Mg_5Ga_2$ | 114 | 431 | 1.9 | 33 | 211 |
| 4 | 90 | 4 | 6 | Mg + $Mg_5Ga_2$ | 128 | 461 | 2.8 | 35 | 232 |
| 5 | 86 | 8 | 6 | Mg + $Mg_5Ga_2$ | 146 | 559 | 3.1 | 38 | 277 |
| 6 | 86 | 12 | 2 | Mg + $Mg_5Ga_2$ | 155 | 420 | 1.0 | 42 | 221 |
| 7 | 88 | 4 | 8 | Mg + $Mg_5Ga_2$ | 151 | 534 | 2.8 | 36 | 260 |
| 8 | 84 | 8 | 8 | Mg + $Mg_5Ga_2$ | 167 | 505 | 1.4 | 36 | 242 |
| 9 | 88 | 6 | 6 | Mg + $Mg_5Ga_2$ | 167 | 530 | 2.2 | 35 | 265 |
| 10 | 87 | 6 | 7 | Mg + $Mg_5Ga_2$ | 181 | 553 | 2.3 | 35 | 272 |
| 11 | 85 | 8 | 7 | Mg + $Mg_5Ga_2$ | 154 | 473 | 1.4 | 34 | 230 |
| 12 | 86 | 4 | 10 | Mg + $Mg_5Ga_2$ | 191 | 549 | 1.7 | 34 | 258 |
| 13 | 92 | 4 | 4 | Mg + $Mg_5Ga_2$ | 120 | 304 | 4.3 | 25 | 159 |

TABLE 1-continued

| No. | C.* (at %) Mg | Al | Ga | Phase | Hv (DPN) | $\sigma_f$ (MPa) | $\epsilon_f$ (%) | E (GPa) | $\sigma_f/\rho$ |
|---|---|---|---|---|---|---|---|---|---|
| 14 | 82 | 12 | 6 | Mg + $Mg_5Ga_2$ | 205 | 697 | 2.5 | 33 | 341 |

*C. = Composition

TABLE 2

| No. | C.* (at %) Mg | Al | Sr | Phase | Hv (DPN) | $\sigma_f$ (MPa) | $\epsilon_f$ (%) | E (GPa) | $\sigma_f/\rho$ |
|---|---|---|---|---|---|---|---|---|---|
| 1 | 90 | 8 | 2 | Mg + $Mg_{17}Sr_2$ | 123 | 358 | 1.3 | 34 | 195 |
| 2 | 92 | 6 | 2 | Mg + $Mg_{17}Sr_2$ | 127 | 383 | 1.5 | 30 | 210 |
| 3 | 88 | 10 | 2 | Mg + $Mg_{17}Sr_2$ | 140 | 442 | 1.4 | 33 | 239 |
| 4 | 94 | 4 | 2 | Mg + $Mg_{17}Sr_2$ | 151 | 452 | 1.2 | 43 | 250 |

*C. = Composition

TABLE 3

| No. | C.* (at %) Mg | Al | Ba | Phase | Hv (DPN) | $\sigma_f$ (MPa) | $\epsilon_f$ (%) | E (GPa) | $\sigma_f/\rho$ |
|---|---|---|---|---|---|---|---|---|---|
| 1 | 88 | 10 | 2 | Mg + $Mg_{17}Ba_2$ | 133 | 420 | 1.4 | 31 | 220 |
| 2 | 94 | 4 | 2 | Mg + $Mg_{17}Ba_2$ | 143 | 429 | 1.2 | 41 | 230 |

*C. = Composition

As shown in Tables 1 to 3, all the samples showed magnitudes of hardness Hv (DPN) invariably exceeding 114, indicating that in hardness they excelled over; and the commercially available magnesium alloys which possess hardness Hv of 60 to 90. They also exhibited outstanding mechanical properties, i.e. tensile strengths exceeding 304 (MPa), elongations at break exceeding 1.0%, Young's moduluses exceeding 25 (GPa), and specific strengths exceeding 159.

EXAMPLE 2

By following the procedure of Example 1, Mg-Al-Ga alloys having varying compositions such as $Mg_{84}Al_8Ga_8$ and $Mg_{92}Al_4Ga_4$ shown in Table 1 and additionally incorporating therein 0.3 atomic % of Zr, 1 atomic % of Zn, 2 or 0.5 atomic % of Ce, or 1 atomic % of Ca (with the relevant portion of Mg substituted with Zr, Zn, Ce, or Ca) were prepared and tested for such characteristic properties as tensile strength by way of comparative evaluation. The results are shown in Table 4.

TABLE 4

| No. | Composition (at %) Mg | Al | Ga | Zr | Zn | Ce | Ca | Phase | Hv (DPN) | $\sigma_f$ (MPa) | $\epsilon_f$ (%) | E (GPa) | $\sigma_f/\rho$ |
|---|---|---|---|---|---|---|---|---|---|---|---|---|---|
| 1 | 83.7 | 8 | 8 | 0.3 | — | — | — | Mg + $Mg_5Ga_2$ | 184 | 552 | 2.4 | 35 | 272 |
| 2 | 91.7 | 4 | 4 | 0.3 | — | — | — | Mg + $Mg_5Ga_2$ | 147 | 447 | 4.0 | 31 | 232 |
| 3 | 87.7 | 4 | 8 | 0.3 | — | — | — | " | 164 | 492 | 1.9 | 40 | 238 |
| 4 | 83.7 | 8 | 8 | 0.3 | — | — | — | " | 182 | 545 | 1.8 | 36 | 260 |
| 5 | 85 | 8 | 6 | — | 1 | — | — | " | 171 | 514 | 2.0 | 29 | 250 |
| 6 | 82 | 12 | 5 | — | 1 | — | — | " | 243 | 743 | 2.4 | 34 | 362 |
| 7 | 88 | 8 | 2 | — | — | 2 | — | * | 151 | 451 | 1.6 | 30 | 223 |
| 8 | 87.5 | 10 | 2 | — | — | 0.5 | — | * | 138 | 382 | 1.4 | 29 | 172 |
| 9 | 85 | 8 | 6 | — | — | — | 1 | * | 215 | 701 | 2.3 | 36 | 349 |
| 10 | 82 | 12 | 5 | — | — | — | 1 | * | 240 | 726 | 2.6 | 36 | 363 |

(*Mg + metastable phase)

It is clearly noted from Table 4 that the Mg-Al-Ga alloys, owing to the addition of Zr, Zn, Ce, or Ca in a small amount, exhibited outstanding mechanical properties, i.e. hardnesses Hv exceeding 147 (DPN), tensile strengths exceeding 382 (MPa), elongations at break exceeding 1.4%, Young's moduluses exceeding 29 (GPa), and specific strengths exceeding 172. This fact indicates that the added element brought about a conspicuous improvement in strength.

EXAMPLE 3

Figure 2:
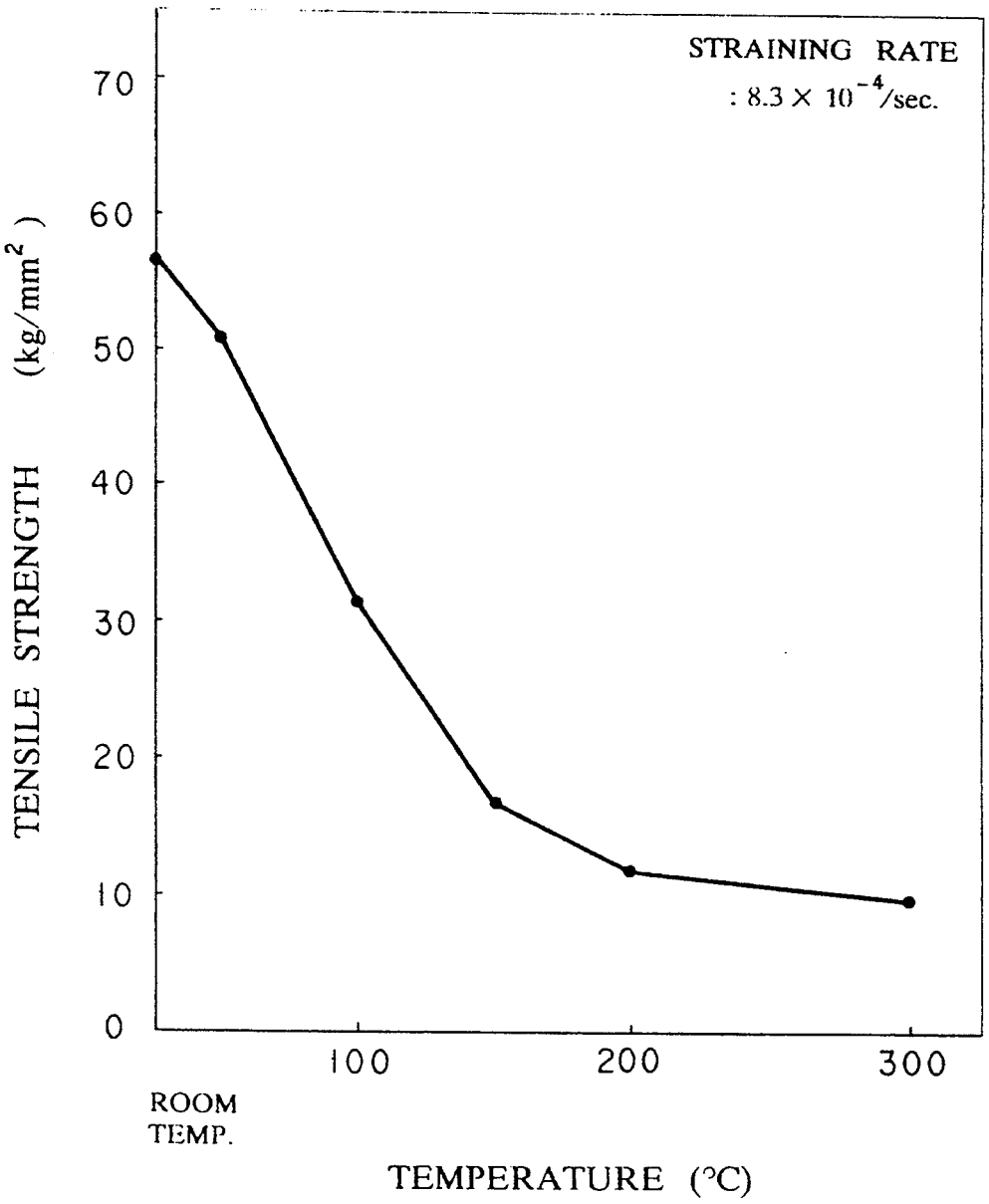
FIG. 2 is a graph showing the relation between the temperature in stretching and the tensile strength found in a tensile test performed on a magnesium-based alloy obtained in Example 3 at a straining rate of $8.3 \times 10^{-4}$/sec.
Figure 3:
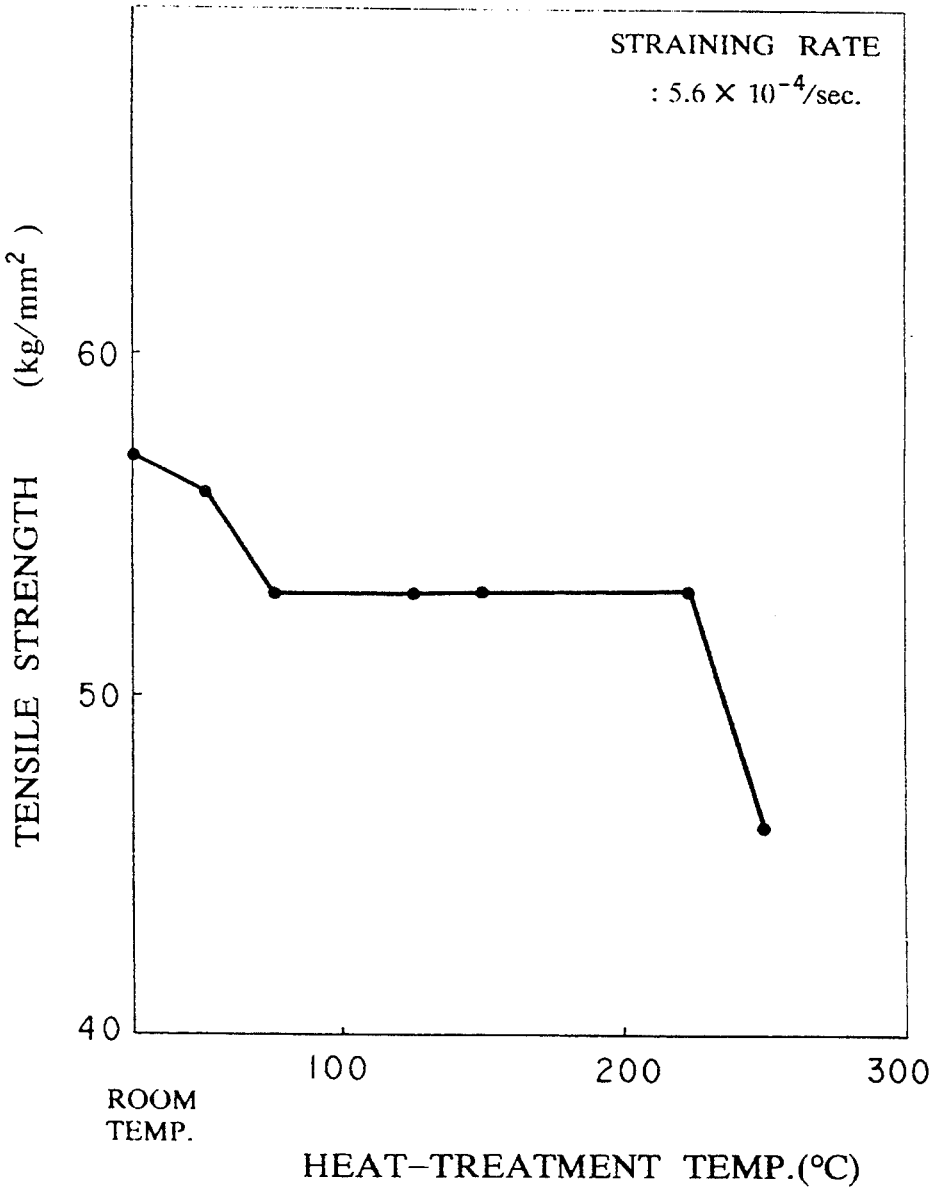
FIG. 3 is a graph showing the relation between the temperature of heat treatment and the tensile strength found in a tensile test performed on the magnesium-based alloy obtained in Example 3 at a straining rate of $5.6 \times 10^{-4}$/sec. after one hour's heat treatment.

The alloy of $Mg_{86}Al_8Ga_6$ designated as No. 5 in Example 1 was tested for the relation between the temperature in a tensile test and the tensile strength and for the tensile strength at room temperature after one hour's heat treatment performed at a stated temperature to determine the relation between the temperature of the heat treatment and the tensile strength. The results are shown in FIGS. 2 and 3. The tensile strength at the elevated temperature represents the magnitude obtained by a measurement made at a strain rate of $8.3\times10^{-4}$/sec. and the tensile strength after the heat treatment the magnitude obtained by a measurement made at a strain rate of $5.6\times10^{-4}$/sec.

It is noted from FIG. 2 that the alloy of the composition of $Mg_{86}Al_8Ga_6$ showed outstanding strength at elevated temperature, i.e. 530 MPa at 50° C., 320 MPa at 100° C., 110 MPa at 200° C., and 100 MPa at 300° C.

From FIG. 3, it is noted that the alloy of the composition of $Mg_{86}Al_8Ga_6$ showed outstanding tensile strength after one hour's heat treatment at a stated temperature, i.e. not less than 530 MPa at not more than 75° C. of heat-treatment temperature and 530 MPa at not less than 75° C. and not more than 225° C. of heat-treatment temperature.

The test results shown above indicate that the alloy of this invention excels in high-temperature strength and strength after heat treatment.

What is claimed is:

1. A high-strength magnesium-based alloy consisting essentially of a composition represented by the general formula: $Mg_aAl_bM_{o1}$ wherein M stands for at least one element selected from the group consisting of Ga and Ba, and a, b, and c stand for atomic % respectively in the ranges of $78 \leqq a \leqq 94$, $2 \leqq b \leqq 12$, and $1 \leqq c \leqq 10$, said alloy having a substantially microcrystalline structure comprising a matrix of microcrystalline magnesium and an intermetallic compound containing at least magnesium as one of the components thereof and uniformly dispersed in said matrix.

2. A high strength magnesium-based alloy according to claim 1, which exhibits a hardness Hv exceeding 114 (DPN), a tensile strength exceeding 304 (MPa), an elongation at break exceeding 1.0%, a Young's modulus exceeding 25 (GPa), and a specific strength exceeding 159.

3. A high strength magnesium-based alloy according to claim 1, which exhibits a tensile strength of from 100 to 530 MPa at an elevated temperature of from 50° to 300° C.

4. A high-strength magnesium-based alloy consisting essentially of a composition represented by the general formula: $Mg_{a'}Al_bM_cX_{d1}$ wherein M stands for at least one element selected from the group consisting of Ga and Ba, X stands for at least one element selected from the group consisting of Zn, Ce, Zr, and Ca, and a', b, c and d stand for atomic % respectively in the ranges of $75 \leqq a' \leqq 94$, $2 \leqq b \leqq 12$, $1 \leqq c \leqq 10$, and $0.1 \leqq d \leqq 3$, said alloy having a substantially microcrystalline structure comprising a matrix of microcrystalline magnesium and an intermetallic compound containing at least magnesium as one of the components thereof and uniformly dispersed in said matrix.

5. A high strength magnesium-based alloy according to claim 4, which exhibits a hardness exceeding 147 (DPN), a tensile strength exceeding 382 (MPa), an elongation at break exceeding 1.4%, a Young's modulus exceeding 29 (GPa), and a specific strength exceeding 172.

6. A high-strength magnesium-based alloy according to claim 1 or 4, wherein the intermetallic compound has microcrystalline phases of at least one intermetallic compound selected from a group consisting of $Al_2Mg_3$, $Mg_5Ga_2$, and $Mg_{17}Ba_2$ uniformly and finely dispersed in the Mg matrix of a hexagonal close-packed structure.

7. A high-strength magnesium-based alloy consisting essentially of a composition represented by the general formula: $Mg_{a'}Al_bGa_cX_{d1}$ wherein X stands for at least one element selected from the group consisting of Zn, Ce, Zr, and Ca, and a', b, c and d stand for atomic % respectively in the ranges of $75 \leqq a' \leqq 94$, $2 \leqq b \leqq 12$, $1 \leqq c \leqq 10$, and $0.1 \leqq d \leqq 3$, said alloy having a substantially microcrystalline structure comprising a matrix of microcrystalline magnesium and an intermetallic compound containing at least magnesium as one of the components thereof and uniformly dispersed in said matrix.

8. A high strength magnesium-based alloy according to claim 1, 4 or 7, which is obtained by rapidly solidifying the melt of said alloy at a cooling rate of from $10^2$ to $10^6$ K./sec.

9. A high-strength magnesium-based alloy according to claim 1, 4 or 7, wherein said matrix is a hexagonal close-packed structure.

* * * * *